US007229111B2

(12) United States Patent
Cohen et al.

(10) Patent No.: US 7,229,111 B2
(45) Date of Patent: Jun. 12, 2007

(54) TWEEZER, KIT, METHOD, AND PACKAGE

(75) Inventors: Emily M. Cohen, New York, NY (US); Edward John Rella, East Brunswick, NJ (US); Nicholas Anthony Sileo, Rahway, NJ (US); Mary Jeanne Snyder, Massapequa, NY (US); Catherine Ann Wohlfeil, New York, NY (US); Anne Bernadette Talley, Harrison, NY (US); James Michael Pojednic, Oradell, NJ (US); John D. Butcher, Scotch Plains, NJ (US); Sharom A. Naioti, Purchase, NY (US); Stacey Leigh Grabiner, Westfield, NJ (US); Heather S. Sopczynski, New York, NY (US); Antonette Bivona, Bayside, NY (US); Steven Schnipper, New York, NY (US); Yong Hoon Cho, Fullerton, CA (US)

(73) Assignee: Revlon Consumer Products Corporation, New York, NY (US)

( * ) Notice: Subject to any disclaimer, the term of this patent is extended or adjusted under 35 U.S.C. 154(b) by 280 days.

(21) Appl. No.: 10/914,571

(22) Filed: Aug. 9, 2004

(65) Prior Publication Data

US 2006/0028040 A1 Feb. 9, 2006

(51) Int. Cl.
*B25B 9/02* (2006.01)

(52) U.S. Cl. ..... 294/99.2

(58) Field of Classification Search ..... 294/3, 294/16, 99.2; 606/205–207, 210, 211
See application file for complete search history.

(56) References Cited

U.S. PATENT DOCUMENTS

| | | | | |
|---|---|---|---|---|
| 1,767,296 | A * | 6/1930 | Lewis | 7/168 |
| 2,406,393 | A * | 8/1946 | Neugass | 606/133 |
| 3,264,909 | A * | 8/1966 | Block | 294/99.2 |
| 3,818,784 | A * | 6/1974 | McClure | 294/99.2 |
| 3,906,957 | A * | 9/1975 | Weston | 606/205 |
| 4,634,165 | A | 1/1987 | Russell | 294/99.2 |
| 4,941,700 | A * | 7/1990 | Lin et al. | 294/99.2 |
| 4,967,446 | A | 11/1990 | Padel | 452/3 |
| 5,190,335 | A | 3/1993 | Rommerdale | 294/99.2 |
| 5,334,215 | A * | 8/1994 | Chen | 606/210 |
| 5,899,513 | A | 5/1999 | Grisoni | 294/99.2 |
| 6,276,734 | B1 * | 8/2001 | Krieger | 294/99.2 |
| D452,937 | S | 1/2002 | Grisoni | D28/55 |
| D470,626 | S | 2/2003 | Sugiyama | D28/55 |
| 2004/0006357 | A1 | 1/2004 | Baldesberger | 606/167 |

* cited by examiner

*Primary Examiner*—Dean J. Kramer
(74) *Attorney, Agent, or Firm*—Joy S. Goudic

(57) ABSTRACT

The present disclosure relates to a tweezer comprised of a handle and a detachably engageable tweezer component that engages with the handle and is detachable from the handle, a kit containing the handle and the detachably engageable tweezer component, point-of-sale packages, and a method for grooming using the tweezer of the invention.

27 Claims, 7 Drawing Sheets

TWEEZER, KIT, METHOD, AND PACKAGE

TECHNICAL FIELD

This invention is in the field of beauty tools, specifically a tweezer comprising handle with interchangeable tweezer tips, kits containing the handle and interchangeable tips, and point-of-sale packages containing the handle, tweezer tips, or both.

BACKGROUND OF THE INVENTION

Almost everyone owns a tweezer, which is generally a small metal instrument having two arms, which is held between the thumb and forefinger and used to pluck small hairs, remove slivers, or similar grooming activities. There are a number of need gaps with respect to tweezers. First, tweezer size and shape, particularly with respect to the tips, is variable depending on the desired end use. For example, tweezers having slant tips are the most popular style and are ideal for general tweezing purposes, and on curved surfaces such as the eye socket. Pointed tip tweezers are most desirable for precision use such as eyebrow shaping, or removing very short or ingrown hairs, or slivers. Square tip tweezers have a blunted square edge. In addition to being safe and gentle, they are good for use on flat surfaces such as between the eyebrows.

Accordingly, a consumer who desires to use tweezers for a variety of end uses must purchase a number of different tweezers. Because this becomes expensive, consumers tend to purchase only one tweezer and use that for all end uses even though the type of tweezer may not be optimal for all desired uses.

The second need gap relates to the way in which the tweezer is held and manipulated. For cost and practical reasons, tweezers tend to be of a standard size. The leverage obtained with a standard tweezer may not be optimal for elderly people, or for tweezing on bodily areas that are difficult to reach. In those cases, it would be most advantageous to have tweezer arms that were longer and easier for the user to manipulate.

Accordingly, it is an object of the invention to provide a tweezer comprised of a handle and a tweezer component where the tweezer component is detachable from the handle and interchangeable with other tweezer components such that the consumer can detach the tweezer component from the handle and attach another tweezer component to the handle as desired.

It is a further object of the invention to provide a kit comprised of a handle and at least two tweezer components that are detachable from the handle and interchangeable with each other.

It is a further object of the invention to provide a method for grooming comprising preparing a handle and at least two tweezer components detachably engageable with said handle such that the consumer can engage a first tweezer component in said handle and conduct the desired grooming activity, and then detach the first tweezer component and engage a second tweezer component in the handle to be used for another grooming activity.

It is a further object of the invention to provide a point-of-sale package comprised of a handle and at least one tweezer component engagable with, and detachable from, said handle, and a second point-of-sale package comprising at least one tweezer component engagable with and detachable from the handle in the first package.

SUMMARY OF THE INVENTION

The invention is directed to a tweezer comprised of a handle and a tweezer component that is interchangeably engageable with, and detachable from the handle.

The invention is also directed to a kit comprised of a handle and at least one tweezer component that is interchangeably engagable and detachable from the handle.

The invention is further directed to an in-store display having a first a point-of-sale package containing a handle and at least one tweezer component that is interchangeably detachable and engageable with the handle, and a second point-of-sale package having at least one tweezer component that is interchangeably detachable and engageable with the handle in the first point-of-sale package.

The invention is further directed to a method for grooming with a tweezer comprised of a handle and a plurality of tweezer components that are interchangeably detachable and engageable with said handle, comprising engaging a tweezer component to said handle and using the tweezer for the desired grooming activity, then detaching said tweezer component and engaging another tweezer component with said handle and engaging in a second grooming activity.

BRIEF DESCRIPTION OF THE DRAWINGS

FIG. 4A: shows a tweezer component having a pointed tip.

FIG. 4B: shows another tweezer component having a blunt tip.

FIG. 4C: shows another tweezer component having a slant tip.

FIG. 5A: Shows the handle and tweezer component separately, where the tweezer component is positioned for sliding into the handle.

FIG. 5B: shows the sliding of the tweezer component into the handle, but before the tweezer component is engaged with handle.

FIG. 5C: is a side plan view of the tweezer when the tweezer component is engaged with the handle.

FIG. 5D: is a side view of the tweezer depicted in FIG. 5C showing how the handle and tweezer component align when engaged.

FIG. 5E: is a cross-sectional view taken across f—f of FIG. 5D, and shows how arm of tweezer component engages with handle.

FIG. 5F: is a cross-sectional view taken across 5*f* of FIG. 5E showing how the tweezer component fits into handle.

FIG. 7A: depicts a point-of-sale pack containing a handle and one tweezer component.

FIG. 7B: depicts a second point-of-sale pack containing two tweezer components that are engagable with and detachable from the handle in the first point-of-sale pack so that the tweezer components in this point-of-sale pack can be interchangeably used with the handle found in the first point-of-sale pack.

FIG. 7C: depicts a third type of point-of-sale pack containing a single tweezer component for use with the handle in the first point-of-sale pack. This tweezer component may be engaged with, and detached from, the handle in the first point-of-sale package.

DETAILED DESCRIPTION

When used herein the term "interchangeable" or "interchangeably" means that one tweezer component may be interchanged with another tweezer component in the handle, and that, in general, the tweezer components are interchangeable with each other in the handle.

The term "engageable" means, with respect to the tweezer component, that it engages, or is secured, to the handle such that the tweezer component is secure enough in the handle to perform the desired grooming activity but may be disengaged when desired.

The term "detachable" means that the tweezer component may be readily detached from the handle when desired, but when engaged with the handle, is secure enough to facilitate the desired grooming activity.

Figure 5A:
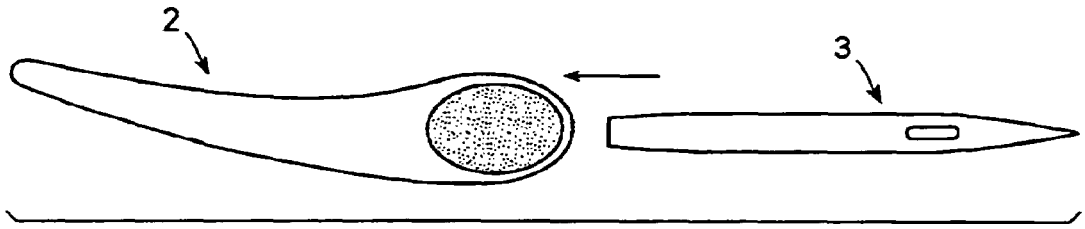
FIGS. 5A–F: show the handle and tweezer component and how the tweezer component is engageable with the handle.
Figure 5B:
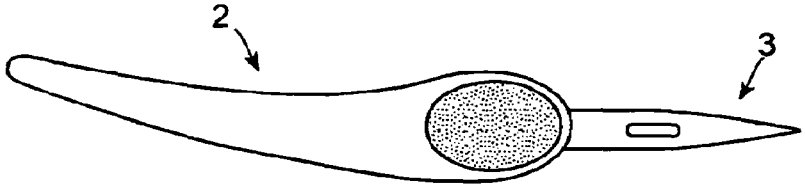
Figure 5C:
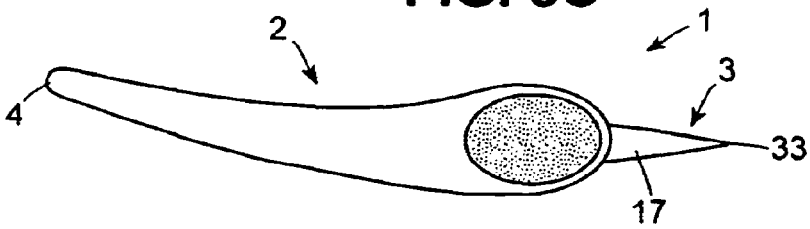
Figure 5D:
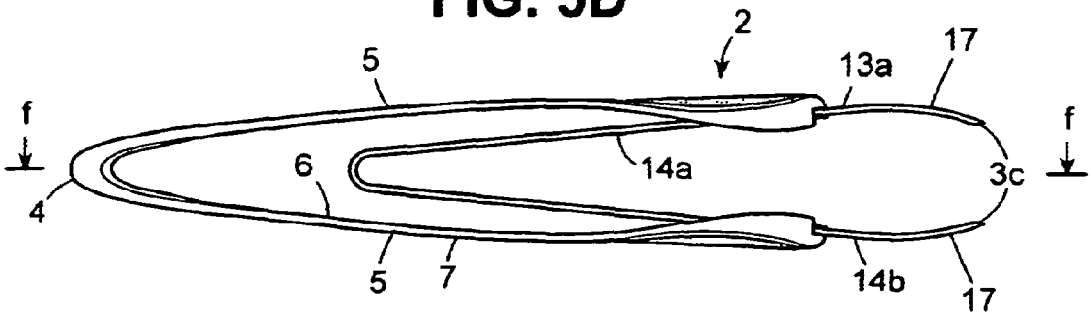

As depicted in FIG. 5C, the first embodiment of the invention is directed to a tweezer 1 having a handle 2 and a tweezer component 3. The handle 2 may be made of metal, any thermoplastic polymeric material such as polyethylene, polypropylene, styrene, styrene-butadiene, and the like. Handle 2 should be preferably made of material that has resilience and flexibility, or a shape memory, so that the handle diverging arms 5 may be depressed or squeezed together to cause handle diverging arms 5 to converge to cause tweezer component 3 tips 3*a* to meet to perform the desired tweezing function when tweezer component 3 is engaged with handle 2, and when pressure is released from handle 2 diverging arms 5, they return to their original spaced apart position, as do tips 3*a* of tweezer component 3.

Figure 8A:
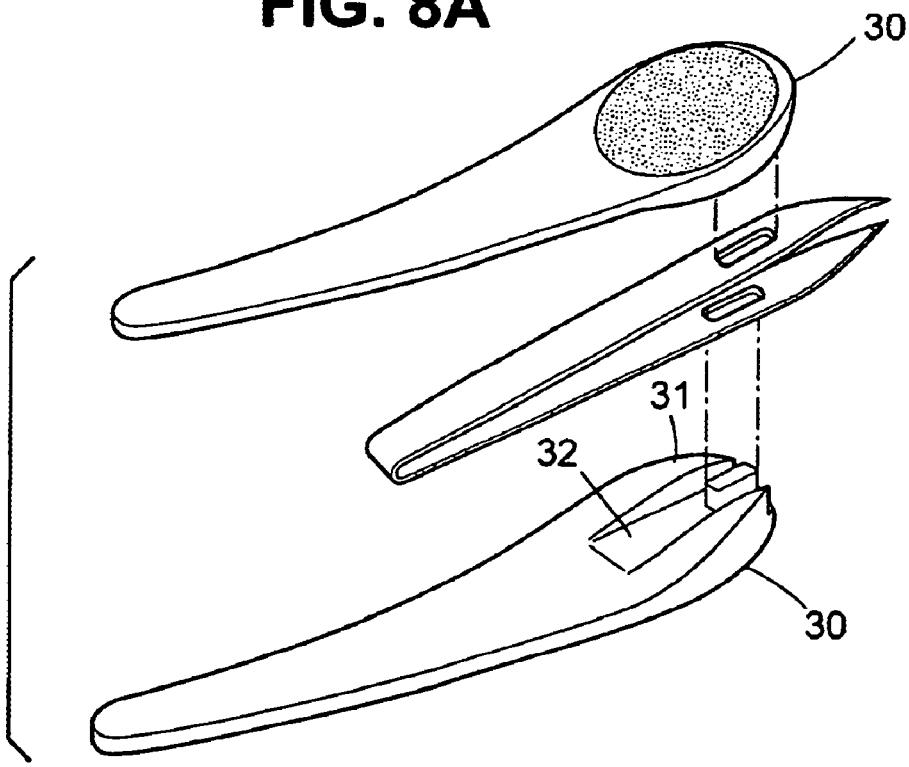
FIG. 8A: depicts an alternate embodiment of the invention where the handle that is affixed to the tweezer component is in two pieces, each separate piece being affixed to one diverging arm of tweezer component.

Preferably, the handle 2 has a unitary base 4 with diverging arms 5, although the handle 2 may comprise two separate arms that may be affixed to the tweezer component 3 as further described in FIG. 8A. For purposes of explanation, in the case where the handle 2 comprises a unitary base 4 with diverging arms 5, the unitary base 4 is referred to as the proximal end 4*a* of the handle and the diverging arms 5 as the distal end 10 of the handle 2. The diverging arms 5 have an inner surface 6 and an outer surface 7. On the outer surface 7 of diverging arms 5, preferably at the distal end 10 of the handle 2, are widened finger grip portions 8, which enable the consumer to easily grip the handle 2 on the outer surfaces 7 thereof with the fingers. If desired, the finger grip portions 8 may be inset with a softer thermoplastic material such as a flexible foam 9, which has some resilience when gripped with the fingers. Particularly preferred is Santoprene rubber, which is a mixture of silicone and rubber. Flexible foam 9 inset may be differently colored than handle 2, may be round, square, or any other shape or design that might provide a commercially aesthetic appearance to handle 2.

Figure 1:
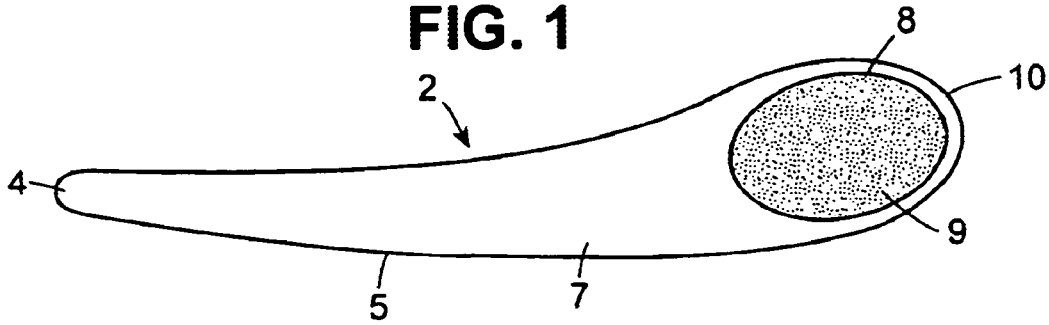
FIG. 1 is a top plan view of a type of handle that may be used to engage a tweezer component in accordance with the invention.
Figure 2:
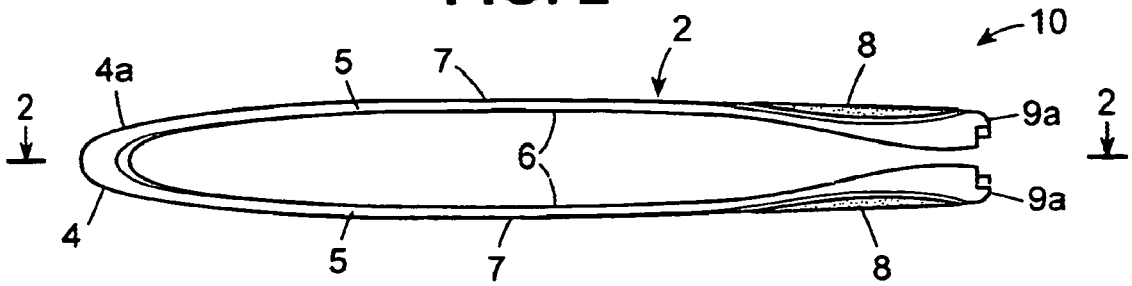
FIG. 2 is a side view of the handle of FIG. 1.

FIG. 2 is a side plan view of the handle 2 of FIG. 1 showing unitary base 4 and diverging arms 5. Widened finger grip portions 8 at the distal end of diverging arms 5 form slightly clubbed ends 9*a* on inner surface 6 of handle 2 diverging arms 5.

Figure 3:
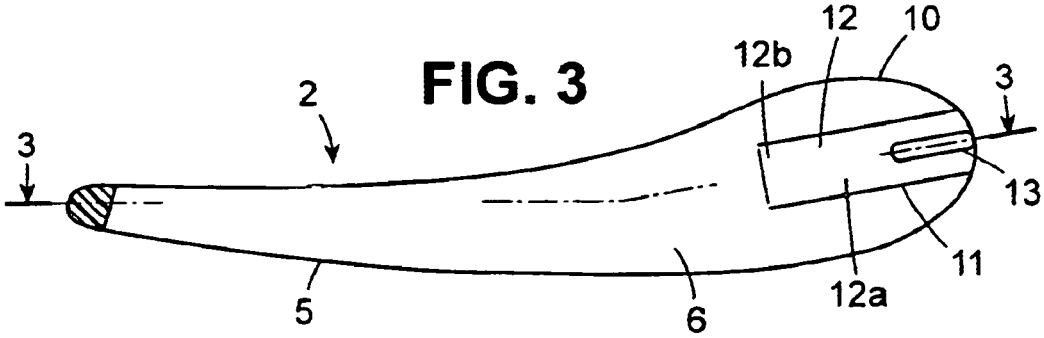
FIG. 3 is a cross-sectional view taken across 2—2 of FIG. 2 showing the inner surface of the handle of FIG. 1.
Figure 3A:
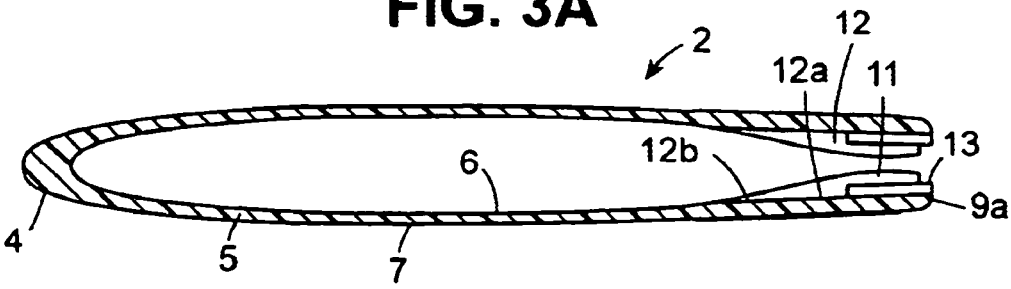
FIG. 3A is a cross-sectional view taken across 3—3 of FIG. 3 showing a side view of the recessed portion found on the inner surface of handle.

FIG. 3 shows a cross-sectional view taken across 2—2 of FIG. 2, showing the inner surface 6 of one of the diverging arms 5 of handle 2. At the distal end 10 of the diverging arms 5, on the inner surface 6, is a recessed protrusion 11 which is comprised of a recessed portion 12 and a protrusion 13, preferably in the form of a long rectangular protrusion. Preferably the recessed portion 12 has a sloping depth such that the depth of recessed portion 12 closest to the edge 12*a* has greater depth than the edge 12*b* that is closer to unitary base 4. FIG. 3A is a cross-sectional view taken across 3—3 of FIG. 3, and is a side view depicting the recessed portion 12 in side view and the sloping depth of the recessed portion 12, with the depth deepest at edge 12*a* and shallowest at edge 12*b*. The larger depth at edge 12*a*, if present, is due to the increased width of clubbed ends 9*a* on inner surface 6 of diverging arms 5. In addition, the recessed portion 12 has a width similar to the width of diverging arms 13*a* of tweezer component 3, which facilitates engagement of diverging arms 13*a* with handle 2.

Figure 4A:
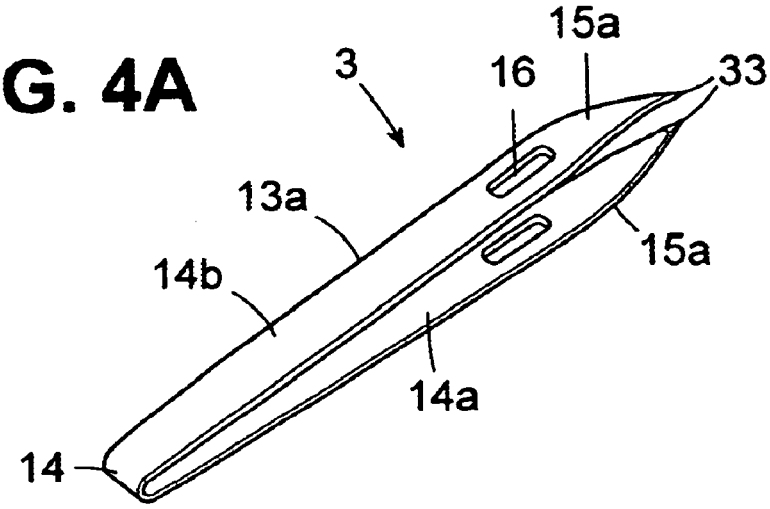
FIGS. 4A–C: depict the various types of tweezer components that may be detachable from and engageable with the handle, and used interchangeably with the handle of FIG. 1.
Figure 4B:
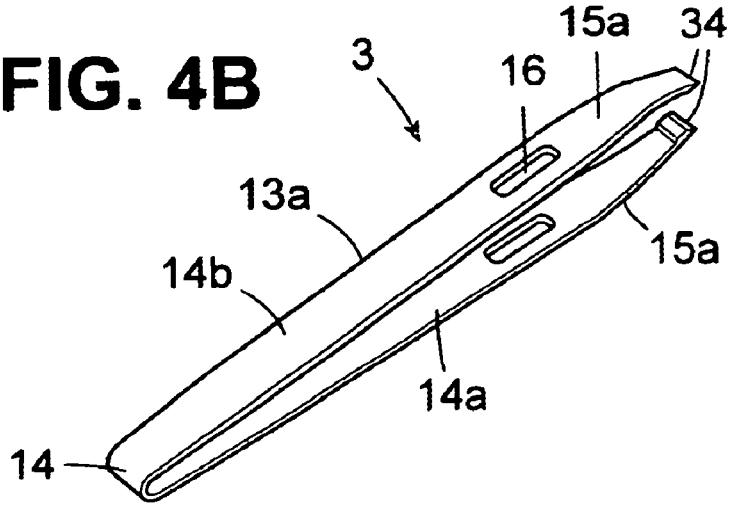
Figure 4C:
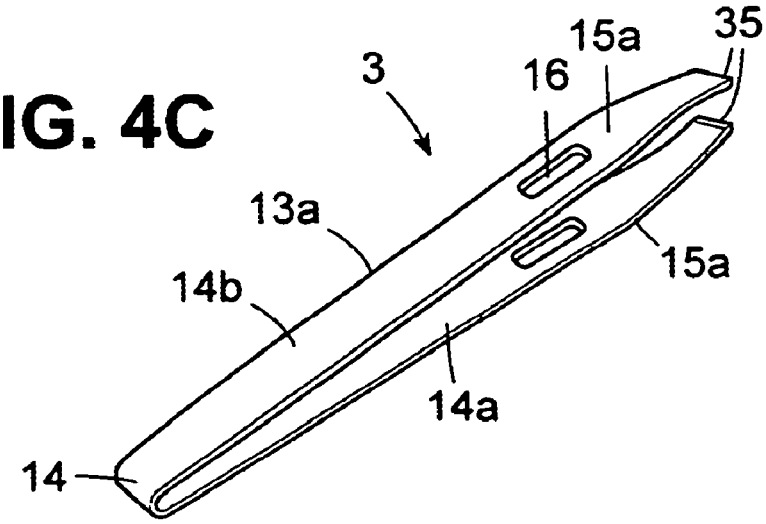

FIGS. 4A–C show side views of three different types of tweezer components 3 that may be used with handle 2. FIG. 4A depicts a pointed tweezer component 3 where the tips of the tweezer are pointed 33, FIG. 4B a blunt tip tweezer component 3 where the tips are blunted 34, and FIG. 4C a slant tip tweezer component 3 where the tips form a diagonal or slant edge 35. Tweezer components have arms 13*a* diverging from unitary base 14. The arms have an inner surface 14*a* and an outer surface 14*b*. The arms have distal ends 15*a* having slits 16 which are of a size and shape such that they may detachably engaged with protrusions 13 on the inner surface 6 of handle 2 recessed portion 12 when tweezer component 3 is inserted into handle 2 as best depicted in FIGS. 5A through F.

While in the preferred tweezer component 3, the slits 16 engage with protrusions 13 when tweezer component 3 diverging arms 13*a* are seated in recessed portion 12, it is possible that depressions could also work in place of slits 16, to the extent that such depressions would still seat with protrusions 13 or similar engagements in a manner sufficient to cause tweezer component 3 diverging arms 13*a* to be reliably engaged with handle 2, but detachable when desired.

In the preferred embodiment of the invention, the tweezer component 3 engages with handle 2 via the slits 16 of tweezer component 3 forming a collar around the protrusions 13 in recessed portion 12 when the tweezer component 3 is inserted into handle 2 as depicted in FIGS. 5A–F and diverging arms 13*a* seat in recessed portion 12 on the inner surface 6 of handle 2 diverging arms 5.

Figure 5E:
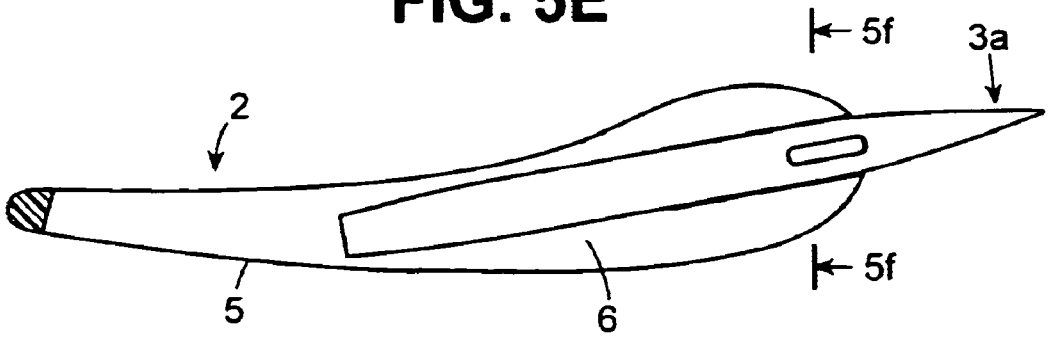
Figure 5F:
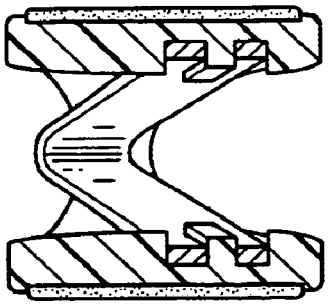

FIG. 5F depicts a side cross sectional view of FIG. 5E taken across 5*f*–5*f* of FIG. 5E showing how the protrusion 13 of handle 2 engages with slit 16 on the diverging arm 13*a* of tweezer component 3. Protrusion 13 fits into slit 16, causing handle 2 to engage with the diverging arm 13*a* of tweezer component 3. A similar engagement is found on both arms of the tweezer component 3 and handle 2.

FIGS. 5A–F depict how the tweezer component 3 is engaged with the handle 2. FIG. 5A illustrates how the tweezer component 3 slides into recessed portion 12 of handle 2 and the slits 16 of tweezer component 3 diverging arms 13*a* engage with the protrusions 13 on handle 2. FIG. 5B illustrates the tweezer component 3 being further slid into handle 2, but before engagement, and FIG. 5C where the tweezer component 3 has been fully engaged with handle 2. When tweezer component 3 is fully engaged with handle 2 the tips 17 of tweezer component 3 extend from the distal end of the handle 2 for a certain distance, generally about 0.25 to 2 inches. The user grips the handle 2, preferably at the widened finger grip portions 8 and manipulates handle 2 to perform the desired tweezing function by compressing diverging arms 5 of handle 2 to cause tips 17 to come together as depicted in 3*c*.

Figure 6A:
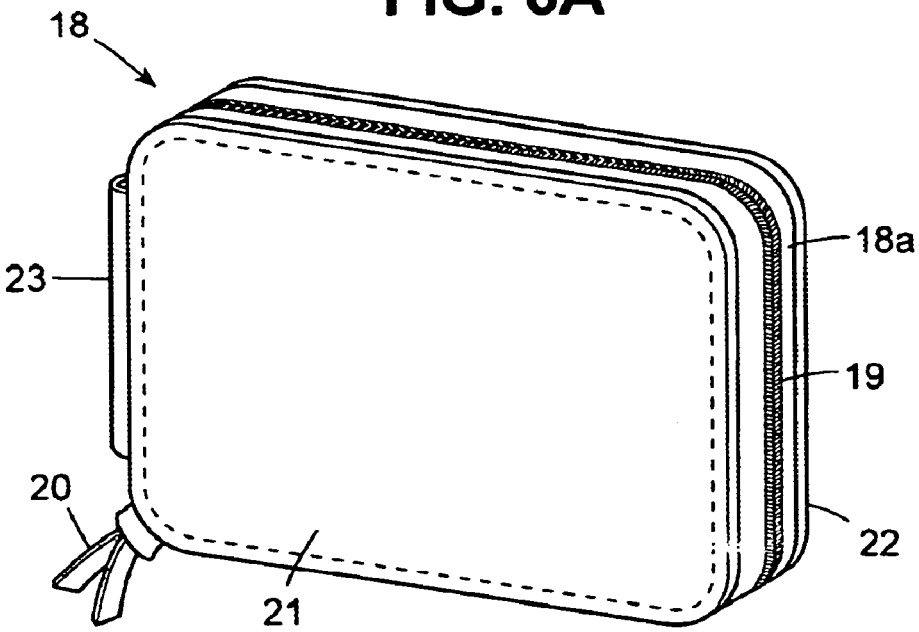
FIG. 6A: shows one type of kit, a case with zippered closure, suitable for containing the tweezer comprised of a handle and at least one tweezer component.
Figure 6B:
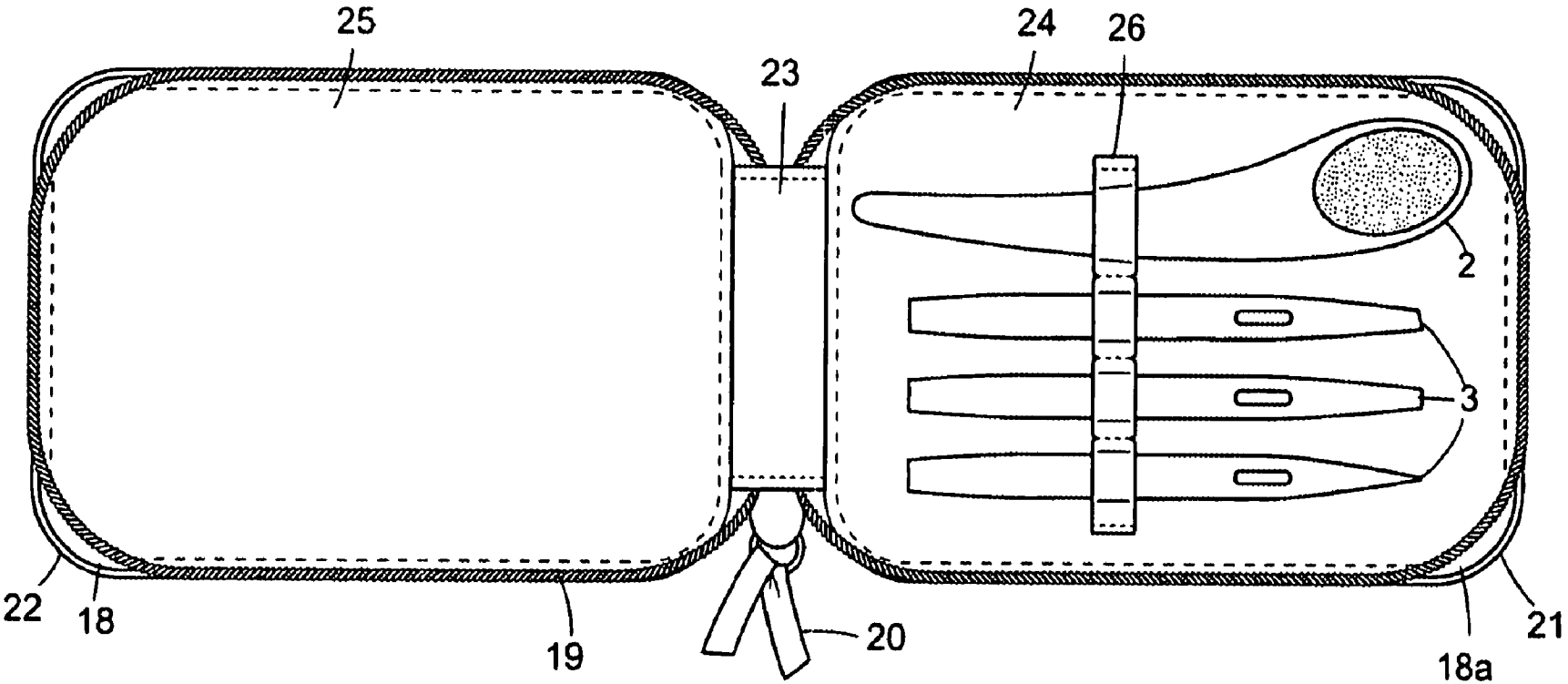
FIG. 6B: shows the kit of FIG. 6A in the open position, and the handle with three tweezer components having a slant tip, blunt tip, and pointed tip, and secured to the inner case with elasticized loops.

FIG. 6A depicts a kit 18, which is a pouch 18*a* that may be made from leather, plastic, or cloth. The pouch is preferably closed by a zipper 19, with a zipper handle 20 that facilitates opening and closing of the zipper 19. In one embodiment, the pouch 18*a* preferably comprises a top half 21 and a bottom half 22 that are foldable on top of each other by folding the top half 21 over the bottom half 22 on seam 23. The pouch 18*a* may be closed by zipper 19, using zipper handle 20, as best depicted in FIG. 6A. The handle 2 for tweezer components 3 and the tweezer components 3 may be affixed to the inner surface 24 of top half 21 or the inner surface 25 of bottom half 22. The handle 2 and tweezer components 3 may be affixed to inner surface 24 or 25 by elasticized loops 26 or something similar, as depicted in FIG. 6B.

Figure 7A:
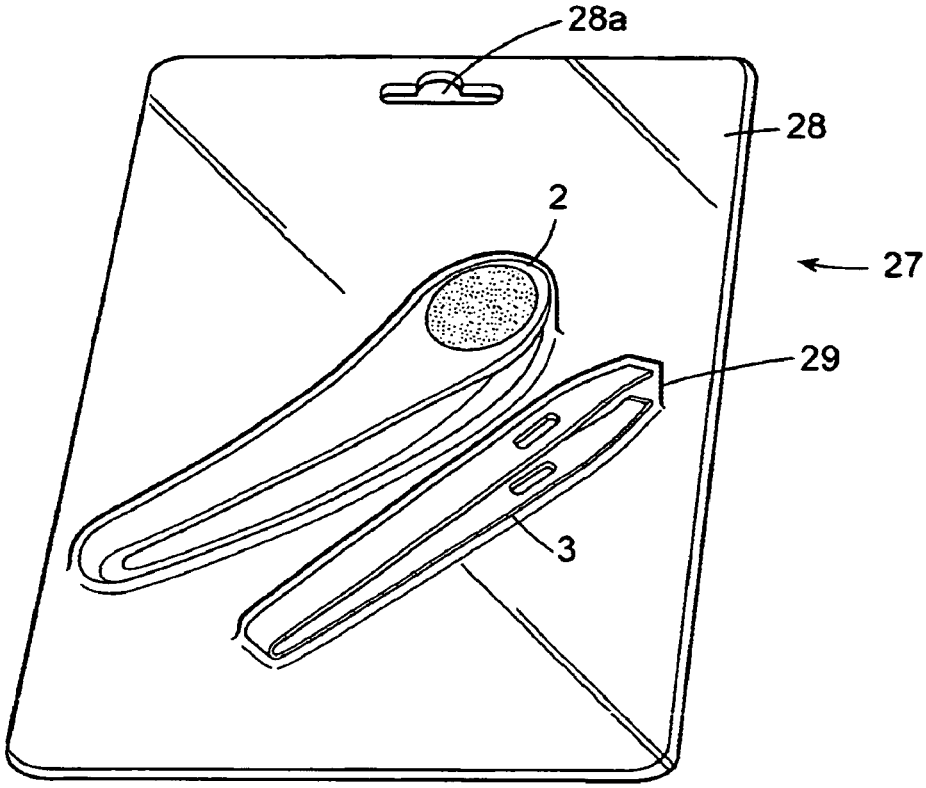
FIGS. 7A–C show the types of point-of-sale packs that may be used to sell the tweezer of the invention.
Figure 7B:
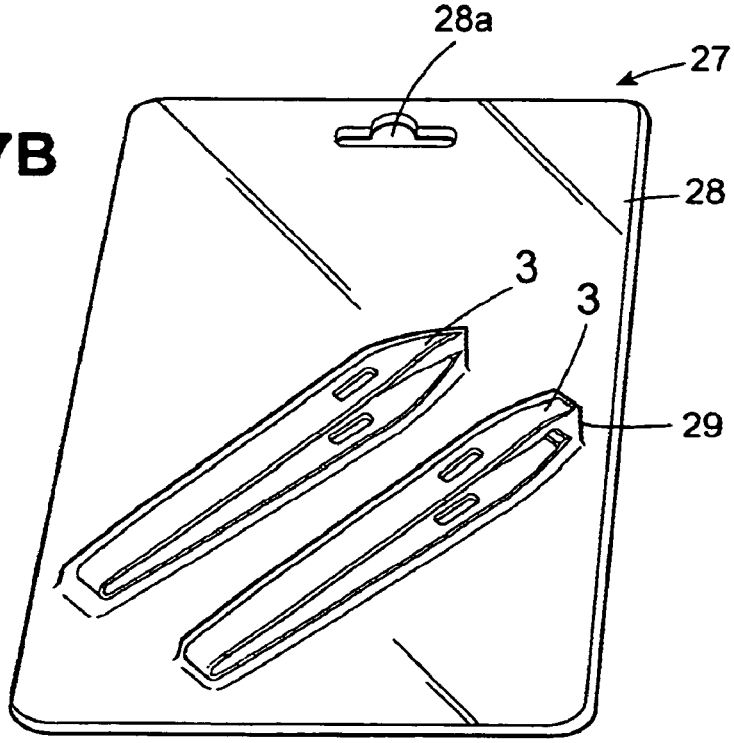
Figure 7C:
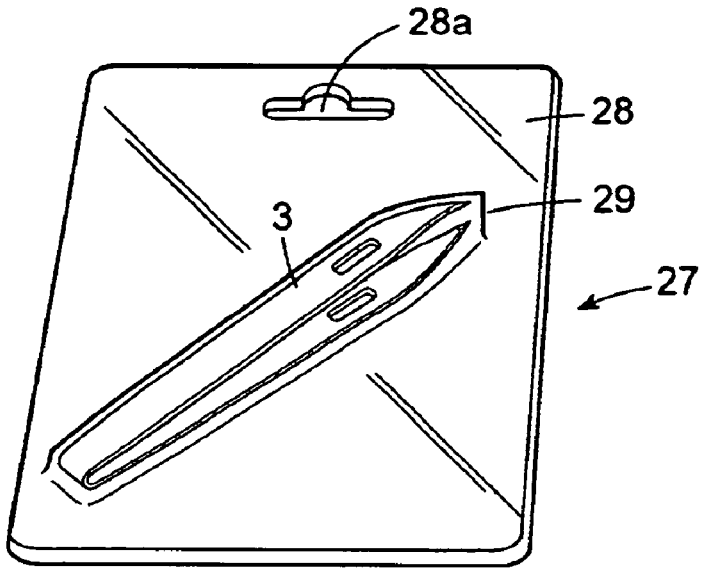

FIGS. 7A–C depict point-of-sale packages suitable for selling the tweezer of the invention. In FIG. 7A, one point-of-sale pack 27 may contain the handle 2 and one tweezer component 3 affixed to a card 28 by blistering 29 the handle 2 and tweezer component 3 onto the card 28. The term "blistering" or "blister" means to prepare thermoformed plastic that is preferably see through, which is used to overlayer over the handle 2 and tweezer component 3 to affix them to card 28 and keep them in place on the card 28 but yet to enable the consumer to see the handle 2 and tweezer component 3 on the card 28 in the store. Blistering is a common way to sell various cosmetic items because the card 28 can be used to print indicia relevant to the handle 2 and tweezer component 3 such as instructions for use, corporate information, graphics, advertising, or the like. Preferably the card 28 has a hang tag 28*a* which facilitates hanging of the card 28 on hook and hang displays that are typically found in stores where such products are sold.

FIGS. 7B and 7C illustrate second point-of-sale packages where tweezer components 3 are affixed to the card 28 by blistering 29. The tweezer components 3 blistered to cards 28 in FIGS. 7B and 7C can be used with handle 2 that is sold in the point-of-sale package as depicted in FIG. 7A. In particular, the consumer will purchase the package depicted in FIG. 7A, containing the handle 2 and tweezer component 3 blistered 29 to the card 28. When the consumer desires to purchase another tweezer component 3 for another tweezing purpose, the consumer may separately purchase the tweezer components 3 depicted in point-of-sale package depicted in FIG. 7B or 7C because those tweezer components 3 are interchangeable with the tweezer component 3 in the point-of-sale package in FIG. 7A. The consumer can purchase interchangeable tweezer components 3 in separate purchases by purchasing the point-of-sale packages of 7B and 7C, or similar, when the consumer desires to purchase additional tweezer components 3 for the tweezer handle 2 already purchased in a separate transaction.

FIG. 8A depicts another type of handle 30 that may be used with the tweezer components 3 of the invention. In this case, the handle 2 is in two separate pieces, each of which is attached to one diverging arm 13A of tweezer component 3. While it is preferred that handle 2 be in one piece so that tweezer component 3 can be slipped on and engaged with handle 2 with relative ease, it is possible that handle 30 can be in two pieces, as depicted in FIG. 8A. In the case where handles 30 are in two separate pieces, they can be packaged and sold as depicted in FIGS. 6A–B and 7A–C, either in kits or in point-of-sale packages, or the like.

The invention also comprises a method for grooming using at least two different tweezer components and a handle where the tweezer components are detachable and engageable with the handle and interchangeable with each other. The consumer inserts one tweezer component into the handle and performs the desired grooming activity. Then, when that grooming activity is concluded, the consumer detaches that tweezer component from the handle and inserts a second tweezer component into the handle and performs the second grooming activity. If desired, that tweezer component can be removed and other tweezer components may be inserted into the handle and used to conduct desired grooming activities. When the grooming activities are concluded, if desired, the tweezer component can be detached from the handle and stored in the kit as depicted in FIGS. 6A and B. The method enables the consumer to easily switch tweezers and insert those that are best for the desired grooming activity. For example, if the consumer desires to tweeze hairs around the eye socket, he or she may insert the slant tip tweezer of FIG. 4C into handle 2 and perform the desired grooming activity. When the consumer has finished, she may remove the slant tip tweezer of FIG. 4C from the handle and insert the square tip tweezer of FIG. 4B and use it to, for example, tweeze stray hairs between the eyebrows. Then, the consumer may detach the square tip tweezer of FIG. 4B and engage the tweezer of FIG. 4A in the handle 2 and use it to tweezer very tiny hairs that were not reachable with the other tweezers.

The tweezer, kit, point-of-sale package, and method of the invention provide the consumer with a simple, economical way to obtain an implement that will provide multiple tweezing functions in a device that is ergonomically advantageous and easy to manipulate.

While the invention has been described in connection with the preferred embodiment, it is not intended to limit the scope of the invention to the particular form set forth but, on the contrary, it is intended to cover such alternatives, modifications, and equivalents as may be included within the spirit and scope of the invention as defined by the appended claims.

We claim:

1. A tweezer comprised of a handle and a tweezer component that is interchangeably engageable with, and detachable from the handle, wherein the handle is made of a thermoplastic material that has shape memory, having a unitary base proximal end and arms diverging from the unitary base at the distal end, said arms having inner and outer surfaces wherein on the distal outer surface of arms are widened finger grip portions and on the distal inner surfaces of diverging arms are clubbed ends containing recessed protrusions comprised of a recessed portion and a protrusion wherein the recessed portion has a sloping depth such that the depth of recessed portion closest to the distal end of handle has greater depth than the depth of recessed portion closest to the proximal end of handle.

2. The tweezer of claim 1 wherein the tweezer component has engaging means that mate to detachably engage the tweezer component with the protrusions on distal inner surfaces of diverging arms.

3. The tweezer of claim 1 wherein the widened finger grip portions are inset with a soft thermoplastic material.

4. The tweezer of claim 3 wherein the soft thermoplastic material comprises santoprene rubber.

5. The tweezer of claim 3 wherein the inset is differently colored than the handle.

6. The tweezer of claim 1 wherein the tweezer component is a blunt tip tweezer, a slant tip tweezer, or a pointed tip tweezer.

7. A tweezer comprised of a handle and a tweezer component that is interchangeably engageable with, and detachable from the handle, wherein the handle is made of a thermoplastic material having shape memory, having a unit base proximal end and arms diverging from the unitary base at the distal end, said arms having inner and outer surfaces wherein on the inner distal surfaces of diverging arms are clubbed ends containing recessed protrusions comprised of a recessed portion and a protrusion, wherein the recessed portion has a width that is similar to the width of diverging arms of tweezer component.

8. The tweezer of claim 7 wherein the protrusion is rectangular.

9. The tweezer of claim 7 wherein the recessed portion has a sloping depth such that the depth of the recessed portion closest to the distal end of handle has greater depth than the depth of recessed portion closest to the proximal end of handle.

10. The tweezer of claim 7 wherein the outer surface of distal ends of diverging arms contain one or more widened finger grip portions.

11. The tweezer of claim 10 wherein finger grip portions are inset with a soft thermoplastic material.

12. The tweezer of claim 11 wherein the soft thermoplastic material is santoprene rubber.

13. The tweezer of claim 7 wherein the tweezer is a blunt tip tweezer, a slant tip tweezer, or a pointed tip tweezer.

14. A tweezer comprised of a handle and a tweezer component that is interchangeably engageable with, and detachable from the handle, wherein the handle is made from a thermoplastic polymeric material with shape memory and has a proximal end unitary base and a distal end with diverging arms where diverging arms have an inner and outer surface and wherein on the distal end of inner surface are recessed protrusions; and wherein the tweezer component contains a unitary base and diverging arms with slits, wherein said slits engage with said protrusions to detachably engage said tweezer component into said handle.

15. The tweezer of claim 14 wherein the outer surface of handle has finger grip portions.

16. The tweezer of claim 15 wherein the finger grip portions are widened.

17. The tweezer of claim 16 wherein the widened finger grip portions are inset with a soft thermoplastic material.

18. The tweezer of claim 15 wherein the tweezer component has a blunt tip, slant tip, or pointed tip.

19. The tweezer of claim 14 wherein on one or both of the outer surfaces at distal end of diverging arms is a widened finger grip portion.

20. The tweezer of claim 14 wherein on one or both of the outer surfaces at distal end of diverging arms is a widened finger grip portion inset with a soft thermoplastic material.

21. The tweezer of claim 20 wherein the soft thermoplastic material is santoprene rubber.

22. The tweezer of claim 20 wherein the inset is a different color than the handle.

23. The tweezer of claim 14 wherein one or both of inner surfaces of distal ends of diverging arms form clubbed ends.

24. The tweezer of claim 14 wherein one or both of inner surfaces of distal ends of diverging arms form clubbed ends containing a recessed protrusion.

25. The tweezer of claim 14 wherein one or both of inner surfaces of distal ends of diverging arms form clubbed ends containing a recessed protrusion comprised of a recessed portion and a protrusion.

26. The tweezer of claim 25 wherein recessed portion has a sloping depth such that the depth of the recessed portion closest to the distal end of handle has greater depth than the depth of recessed portion closest to the proximal end of handle.

27. The tweezer of claim 25 wherein protrusion is rectangular.

* * * * *